US005361445A

United States Patent [19]

Giallourakis

[11] Patent Number: 5,361,445

[45] Date of Patent: Nov. 8, 1994

[54] SCRUBBER WASHER APPARATUS

[75] Inventor: Nicholas M. Giallourakis, Tarpon Springs, Fla.

[73] Assignee: Sponge Fishing Co., Inc., Tarpon Springs, Fla.

[21] Appl. No.: 23,939

[22] Filed: Feb. 26, 1993

[51] Int. Cl.[5] ..... A47L 13/12; A47L 13/16

[52] U.S. Cl. ..... 15/118; 15/244.3; 15/209.1; 15/244.1

[58] Field of Search ..... 15/244.1, 244.3, 244.4, 15/208, 209.1, 210.1, 222, 223, 226, 229.11, 118, 121, 105

[56] References Cited

U.S. PATENT DOCUMENTS

| | | | |
|---|---|---|---|
| 720,890 | 2/1903 | Campbell | 15/244.3 |
| 1,796,450 | 3/1931 | Gjorup | 15/244.4 |
| 1,820,256 | 8/1931 | Stewart | 15/244.3 |
| 2,152,697 | 4/1939 | Kingman | 15/244.3 |
| 2,176,831 | 10/1939 | Zimmerman | 15/244.4 |
| 2,209,275 | 7/1940 | Lawrence | 15/244.4 |
| 2,255,497 | 9/1941 | Anderson | 15/229.12 |
| 2,269,871 | 1/1942 | Botelho | 15/244.4 |
| 2,690,661 | 10/1954 | Briggs | 15/244.1 |
| 2,753,581 | 7/1956 | Clark | 15/229.13 |
| 2,827,651 | 3/1958 | Rizk | 15/210.1 |
| 2,880,439 | 4/1959 | Swartz | 15/229.11 |
| 2,924,049 | 2/1960 | Spain | 15/118 |
| 2,940,100 | 6/1960 | Grossmeyer | 15/229.11 |
| 2,948,911 | 8/1960 | Steiner | 15/229.11 |
| 2,958,885 | 11/1960 | Donney . | |
| 3,005,219 | 10/1961 | Miller | 15/118 |
| 3,040,353 | 6/1962 | Gray | 15/244.3 |
| 3,048,939 | 8/1962 | Mears | 15/209.1 |
| 3,083,392 | 4/1963 | Sewell | 15/244.1 |
| 3,252,176 | 5/1966 | Gropper | 15/209.1 |
| 3,324,500 | 6/1967 | Fuller et al. | 15/229.12 |
| 3,350,735 | 11/1967 | Pratt | 15/229.12 |
| 3,406,420 | 10/1968 | Siemund | 15/209.1 |
| 3,629,896 | 12/1971 | Sirnec . | |
| 3,849,225 | 11/1974 | Haertle | 15/244.3 |
| 3,857,133 | 12/1974 | Linenfelser | 15/244.3 |
| 4,015,306 | 4/1977 | Fenster | 15/244.3 |
| 4,159,883 | 7/1979 | Mizell . | |
| 4,670,962 | 6/1987 | Giallourakis | 15/118 |
| 4,769,267 | 9/1988 | Hoyt | 15/244.4 |
| 4,945,599 | 8/1990 | Flynn . | |
| 4,949,417 | 8/1990 | Wertz et al. | 15/118 |
| 5,187,830 | 2/1993 | Giallourakis | 15/244.3 |

FOREIGN PATENT DOCUMENTS

| | | | |
|---|---|---|---|
| 526961 | 9/1956 | Belgium | 15/244.3 |
| 650148 | 1/1929 | France | 15/244.3 |
| 1070031 | 7/1950 | France | 15/244.3 |
| 1177013 | 4/1959 | France | 15/209.1 |
| 2634995 | 2/1990 | France | 15/244.3 |
| 149165 | 4/1937 | Germany | 15/209.1 |
| 438054 | 11/1967 | Switzerland | 15/118 |
| 18576 | of 1888 | United Kingdom | 15/244.3 |
| 16187 | of 1895 | United Kingdom | 15/244.3 |
| 11063 | 1/1916 | United Kingdom | 15/244.3 |
| 451536 | 8/1936 | United Kingdom | 15/244.3 |
| 646075 | 11/1950 | United Kingdom | 15/209.1 |
| 2063058 | 6/1981 | United Kingdom | 15/244.3 |

*Primary Examiner*—David A. Scherbel
*Assistant Examiner*—Tony G. Soohoo
*Attorney, Agent, or Firm*—James Creighton Wray

[57] ABSTRACT

A chamois sponge is provided in a pocketed jacket. The jacket is made of a washing sheet sewn to a scrubbing sheet and receives and holds the chamois sponge. The entire assembly is used to wash a car. When a difficult spot is encountered, the scrubber sheet, typically of a nylon mesh, is used to scrub the spot. The covered sponge gives the jacket form and support, and the sponge can be removed after washing of the car to be rinsed and wrung for drying, waxing and buffing.

10 Claims, 1 Drawing Sheet

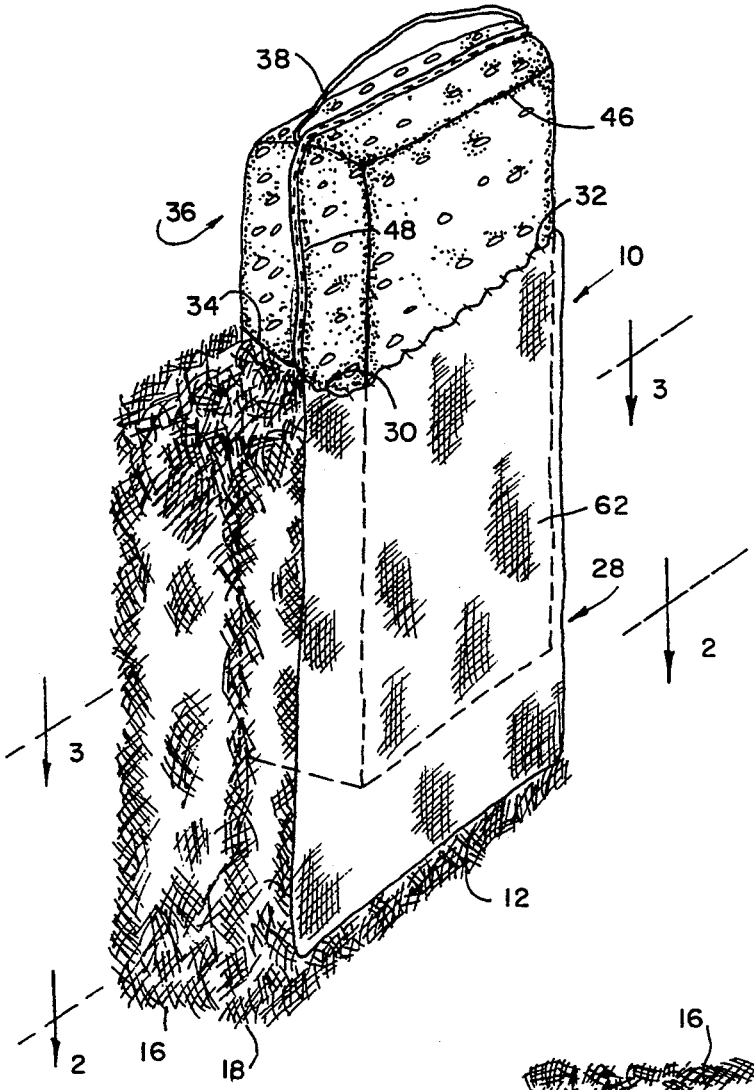
FIG. 1
FIG. 2
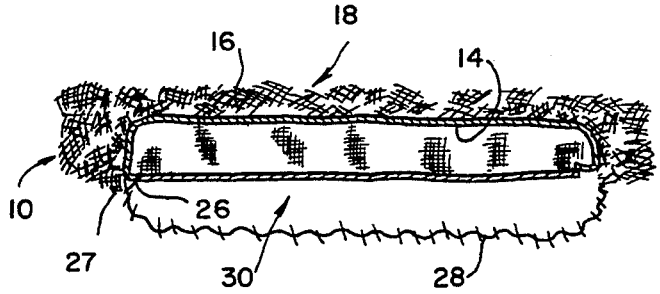
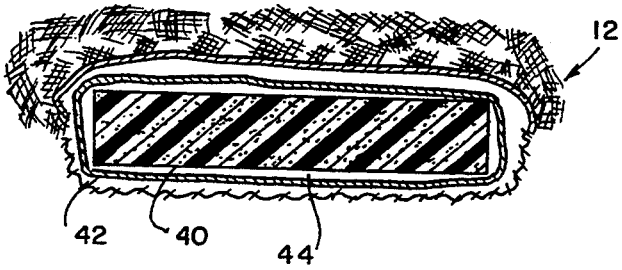
FIG. 3

SCRUBBER WASHER APPARATUS

BACKGROUND OF THE INVENTION

Sponges are widely used in the cleaning of surfaces, and particularly in the washing of automobiles.

Scrubber sponges with a nylon mesh material enclosing the sponge are widely used for scrubbing difficult spots from surfaces.

Fleece washer mitts have been used for cleaning surfaces, and particularly for washing automobiles, and large chamois skins have been widely used for drying automobiles.

The inventor has made and sold sponges permanently encased in scrubber nets, permanently encased in fleece-like materials with exposed fibers, and permanently encased in perforated chamois material.

Washing and drying and scrubbing have required separate implements in the past. One cannot use a scrubbing implement on painted surfaces or highly polished surfaces because of the danger of scratching the surfaces.

A need exists to provide a single implement which is useful and quickly convertable for all purposes of washing and scrubbing, and washing, scrubbing and drying.

SUMMARY OF THE INVENTION

The present invention is directed to the provision of cleaning implements in which washing and scrubbing implements enclose a drying implement, which is removed when washing to provide an envelope for insertion of the user's hand.

A chamois-covered sponge is provided in a pocketed jacket made of a washing sheet material and a scrubbing sheet. The entire assembly is used to wash a car. When a difficult spot is encountered, the scrubbing section of the jacket is used to scrub the spot. The chamois can be removed during washing to remain dry for drying the car, with the user inserting his hand into the pocket for support, or the sponge can be left in the pocket to provide form and support during washing and scrubbing. The sponge can then be rinsed and wrung to be wiped over the washed car to remove excess water and dust.

In a preferred embodiment, the cleaning apparatus comprises a generally rectangular form having spaced longitudinal first and second parallel side edges and spaced first and second end edges at ends of the longitudinal side edges. Stitches join the form together along the edges. An open pocket is formed between the form within the sewn edges of the form, and an opening is formed along an end of the form for providing access to the pocket. The form is preferably made of first and second side sheets. A first side is a washing sheet, and a second side is a scrubbing sheet. The inserted resilient rectangular sponge expels fluid when being squeezed and absorbs fluid when being released. A chamois material overlies and surrounds the block and has edges stitched together, forming a closed pocket for receiving and holding the block and forming with the block a wiper and dryer block. A pull handle may be connected to the wiper block. The wiper block is placed in the open pocket formed by the stitched washer and scrubber sheets, with the handle being exposed through the open end so that the wiper block may be partially or fully withdrawn from the pocket before using the jacket for washing the car or when the block is needed for wiping, drying, wax application or buffing. The block is received within the open pocket in a friction fit for holding the block in the pocket, and for partially holding the wiper block in the first pocket when using an exposed portion of the wiper block for wiping without fully removing the block.

A preferred cleaning apparatus comprises an open pocket formed between the sheets within the sewn longitudinal edges and the sewn first end edges of the sheets. An opening is formed along the second end edges of the sheets for providing access to the first pocket. A resilient rectangular sponge block expels fluid when being squeezed and absorbs fluid when being released. The scrubber block is placed in the first pocket formed by the washing sheet and scrubbing sheet.

These and further and other objects and features of the invention are apparent in the disclosure, which includes the above and ongoing written specification, with the claims and the drawings.

BRIEF DESCRIPTION OF THE DRAWINGS

FIG. 1 is a view of a preferred embodiment of the invention in which a chamois sponge block is partially withdrawn from an opening in a fleece and mesh jacket pocket.

FIG. 2 is a sectional view taken along line 2—2 of FIG. 1.

FIG. 3 is a sectional view taken along line 3—3 of FIG. 1.

DETAILED DESCRIPTION OF THE DRAWINGS

Referring to FIGS. 1, 2 and 3, a washer, scrubber and wiper combination is generally indicated by the numeral 10. The washer jacket 12 is formed of a knitted back 14 fleece material 16 with exposed fibers 18. End edges 26 are stitched together with end edges 27 of a scrubber panel 62, which is preferably made of a semi-abrasive web 28. The result is to form a pocket 30 having upper edges 32, which are left unstitched and which form an opening 34 through which a scrubber block 36 may be inserted. A handle or bail 38 may be incorporated.

The scrubber block 36 is formed with a sponge block 40 and a chamois wiper cover 42, which forms a second closed pocket 44 into which the sponge block 40 is received. The cover 42 is formed preferably by folding an end 46 and by juxtaposing edge portions 48 and stitching those edge portions.

The fleece-like washing sheet forms half of the jacket and half of the pocket, and a web material 62 forms the second half of the jacket and the second half of the pocket. The two sheets are joined together at longitudinal side edges 27 of the web and longitudinal side edges 26 of the washing sheet, and are joined together at first end edge 30 of the chamois and first end edge 27 of the washing sheet. A second end edge of the chamois and of the washing sheet are left open to form the opening 34 of the pocket 30.

In use, the washing side 16 is used in the washing and rinsing of a surface, such as the painted surface on a vehicle and the chrome bumpers and windows.

When a difficult spot is encountered, such as on hub caps or bumpers, the scrubber side 62 is used.

The chamois sponge block is used when wiping or drying. The apparatus is rinsed in clear water and squeezed to expel water through the chamois and expel dirt from the chamois. The block is partially or wholly withdrawn from the pocket.

In preferred embodiments, the sponge block is a high grade polyurethane sponge with honeycomb cell structure for maximum water absorption and dirt expulsion. The mesh material in a preferred form is specially designed, extra stiff diamond weave, 100% nylon-poly mesh.

In preferred embodiments the washing sheet is formed of extra dense, high pile Herculite fibers. The fabric is lock-stitched at the bottom and one side of the pocket. The fabric on which the fibers are mounted is preferably a knitted fabric. Preferably the general direction of the knitting extends around the pocket, and the knitting and mesh covering cooperate to hold the scrubber block in the open pocket by friction.

The preferred drying sheet is a genuine chamois leather, which is perforated to maximize water absorption and dirt expulsion.

While the invention has been described with reference to specific embodiments, modifications and variations of the invention may be constructed without departing from the scope of the invention, which is defined in the following claims.

I claim:

1. Cleaning apparatus, comprising a generally rectangular washing sheet having first and second spaced parallel longitudinal edges and spaced first and second end edges at ends of the longitudinal edges, a generally rectangular scrubbing sheet having first and second spaced parallel longitudinal edges and spaced first and second end edges at opposite ends of the longitudinal edges, stitches joining the sheets together along the first and second spaced longitudinal edges and first end edges of both sheets, an open pocket formed between the sheets within the sewn longitudinal edges and the sewn first end edges of the sheets, an opening formed along the second end edges of the sheets for providing access to the open pocket, a resilient rectangular sponge block for fluid expulsion when being squeezed and fluid absorption when being released, a soft, absorbent, wiping and drying material overlying and surrounding the sponge block and having edges stitched together, forming a closed pocket for receiving and holding the sponge block and forming with the sponge block a wiper and dryer block which readily absorbs and expels water, the wiper and dryer block being placed in the open pocket formed by the washing sheet and scrubbing sheet, the wiper and dryer block being received within the open pocket in a friction fit for holding the wiper and dryer block.

2. The apparatus of claim 1, wherein the washing sheet is a high pile fabric having exposed fibers for sudsing and washing.

3. The apparatus of claim 2, wherein the fibers are Herculite fibers.

4. The apparatus of claim 1, wherein the wiping and drying material overlying sponge is a leather chamois.

5. The apparatus of claim 4, wherein the chamois is perforated for water absorption and dirt expulsion.

6. The apparatus of claim 1, further comprising a pull handle connected to the wiper and dryer block and extending out of the open pocket for removing the sponge block from the open pocket.

7. The apparatus of claim 6, wherein the washing sheet is a high pile fabric having exposed fibers for sudsing and washing.

8. The apparatus of claim 7, wherein the fibers are Herculite fibers.

9. The apparatus of claim 6, wherein the wiping and drying material is a leather chamois.

10. The apparatus of claim 9, wherein the chamois is perforated for water absorption and dirt expulsion.

* * * * *